US007264065B2

(12) United States Patent
Simm et al.

(10) Patent No.: US 7,264,065 B2
(45) Date of Patent: Sep. 4, 2007

(54) SHIFTING DEVICE

(75) Inventors: Robert Simm, Oekingen (CH); Cornelis Van Der Schans, Dietlikon (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/287,722

(22) Filed: Nov. 28, 2005

(65) Prior Publication Data

US 2006/0113097 A1 Jun. 1, 2006

(30) Foreign Application Priority Data

Nov. 30, 2004 (DE) ..... 10 2004 057 686

(51) Int. Cl.
*B25D 9/04* (2006.01)

(52) U.S. Cl. ..... 173/48; 173/109; 173/201

(58) Field of Classification Search ..... 173/48, 173/109, 114, 201, 217
See application file for complete search history.

(56) References Cited

U.S. PATENT DOCUMENTS 3,680,642 A 8/1972 Kirn et al.
4,506,743 A * 3/1985 Grossmann ..... 173/48
5,159,986 A * 11/1992 Hoser ..... 173/48
5,456,324 A * 10/1995 Takagi et al. ..... 173/48
5,842,527 A * 12/1998 Arakawa et al. ..... 173/48
6,015,017 A 1/2000 Lauterwald
6,109,364 A * 8/2000 Demuth et al. ..... 173/48
6,192,996 B1 * 2/2001 Sakaguchi et al. ..... 173/48
6,520,267 B2 * 2/2003 Funfer et al. ..... 173/48
6,557,648 B2 * 5/2003 Ichijyou et al. ..... 173/48
6,666,284 B2 * 12/2003 Stirm ..... 173/97
6,712,156 B2 * 3/2004 Funfer ..... 173/48
6,971,455 B2 * 12/2005 Shibata et al. ..... 173/48
7,174,969 B2 * 2/2007 Droste ..... 173/48

FOREIGN PATENT DOCUMENTS

EP 0 775 555 5/1997
EP 1 477 280 11/2004

* cited by examiner

*Primary Examiner*—Scott A. Smith
(74) *Attorney, Agent, or Firm*—Michael J. Striker

(57) ABSTRACT

A shifting device has a first shifting element, a second shifting element, and a rotatably supported user-operation element including a converter element for converting a rotary motion of the user-operation element into a displacement of the first shifting element in a first direction, the user operation element also including a converter element for converting the rotary motion of the user-operation element into a displacement of the second shifting element in a second direction.

10 Claims, 5 Drawing Sheets

SHIFTING DEVICE

BACKGROUND OF THE INVENTION

The invention relates to a shifting device and to a hand power tool.

It has already been proposed that a percussion drill be equipped with a shifting device, which includes a first shifting element that meshes with a gear-changing mechanism of the percussion drill. The shifting device includes a user-operation element, rotatably supported in a housing of the percussion drill, with a peglike converter element, located eccentrically on the user-operation element and protruding into the interior of the housing, for converting a rotary motion of the user-operation element into a displacement of the first shifting element in a first direction. The first shifting element cooperates with a shifting fork by way of which a gear change of the gear-changing mechanism can be tripped. The percussion drill further includes a second shifting element, which may be embodied for instance for shifting a percussion mechanism of the percussion drill on and off, or as an on/off switch. The first shifting element and the second shifting element must be actuated separately from one another and are each associated with a separate user-operation element.

SUMMARY OF THE INVENTION

Accordingly, it is an object of the present invention to provide a shifting device and a hand power tool, which are further improvements of the existing shifting devices and hand power tools.

The invention is based on a shifting device, in particular for an electric power tool, having a first shifting element, having a second shifting element, and having a rotatably supported user-operation element which includes a converter element for converting a rotary motion of the user-operation element into a displacement of the first shifting element in a first direction, It is proposed that the user-operation element includes a converter element for converting the rotary motion of the user-operation element into a displacement of the second shifting element in a second direction. As a result, both shifting elements can advantageously be displaced by the same user-operation element. Additional user-operation elements can be dispensed with. Moreover, it can easily be achieved structurally that the second shifting element is actuatable only as a function of a position of the first shifting element, or that in certain configurations of the first shifting element, the second shifting element is blocked. The ease of use can also be enhanced.

The provisions according to the invention can be used in principle in all power tools with shifting devices of this generic type. The ease of use can be especially enhanced, however, in hand power tools and electric power tools, since it can be made possible to operate both shifting elements with one hand. In this context, the term "displacement" should be understood in particular as a translational motion or a pivoting motion.

In a first embodiment of the invention, it is proposed that the first direction extends at least substantially perpendicular to the second direction. The phrase "at least substantially perpendicular" should be understood to mean an angle between the two directions that in particular is in the range of 60° to 120°, or 80° to 100°. As a result, it can be attained that the actuation of the various shifting elements is done in clearly separate rotary position ranges of the user-operation element, especially whenever both shifting elements are meshing with the same, eccentrically located converter element.

Convenient gear changing is attainable if the first shifting element is intended for engagement with a gear-changing mechanism. The shifting element may also be intended for displacing a layshaft gear. Advantageous synchronization and vibration damping are attainable if the shifting element is in communication with the mechanism or the layshaft gear via at least one spring element.

It is furthermore proposed that the second shifting element is intended for tripping an electronic shifting event. As a result, a convenient, sturdy shifting device for an electronic shifting event can be attained. In this context, an "electronic shifting event" should be understood as the closing or opening of a current circuit, or the variation of a control voltage. If the first shifting element is intended for tripping a mechanical shifting event and the second shifting element is intended for tripping an electronic shifting event, it is advantageously possible to integrate both types of shifting events in the same shifting device, and user operation independently of the type of shifting event can be achieved.

Safe, precise guidance of the displacement of the first or second shifting element can be attained if the shifting device has gear shifting gate for guiding the converter element.

Decoupling of the displacement of the first shifting element from the displacement of the second shifting element in at least one rotary position can be attained if the gear shifting gate in that rotary position of the user-operation element extends at a tangent to a path curve of the converter element. Decoupling of the displacements can be attained over an entire region if the gear shifting gate is embodied in the form of a circular arc in at least one portion. The decoupling ensues whenever the converter element is located eccentrically to the axis of rotation of the user-operation element, and when a center of curvature of the circular-arc-shaped region coincides with the axis of rotation of the user-operation element.

An economical embodiment of the converter element can be attained if the latter is embodied as a pin. The converter element can be integrally formed onto either the user-operation element or the shifting element.

A gear shifting gate that is specifically adapted to the task of the first shifting element can be implemented if the first shifting element includes the gear shifting gate. The user-operation element can then be designed nonspecifically and can be used for various kinds of shifting devices.

Unintentional twisting of the user-operation element can be avoided if the shifting device includes at least one detent element for fixing a rotary position of the user-operation element.

Increased independence of the displacement motions of the two shifting elements can be achieved if the converter element for converting the rotary motion of the user-operation element into the displacement of the first shifting element is embodied separately from the converter element for converting the rotary motion of the user-operation element into the displacement of the second shifting element.

The invention is furthermore based on a hand power tool, in particular a percussion drill, having a shifting device which includes a first shifting element, a second shifting element, and a rotatably supported user-operation element, and the user-operation element includes a converter element for converting a rotary motion of the user-operation element into a displacement of the first shifting element in a first direction It is proposed that the user-operation element includes a converter element for converting a rotary motion of the user-operation element into a displacement of the second shifting element in a second direction. As a result, it advantageously becomes possible to operate both shifting elements via the same user-operation element, and increased convenience can be attained.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
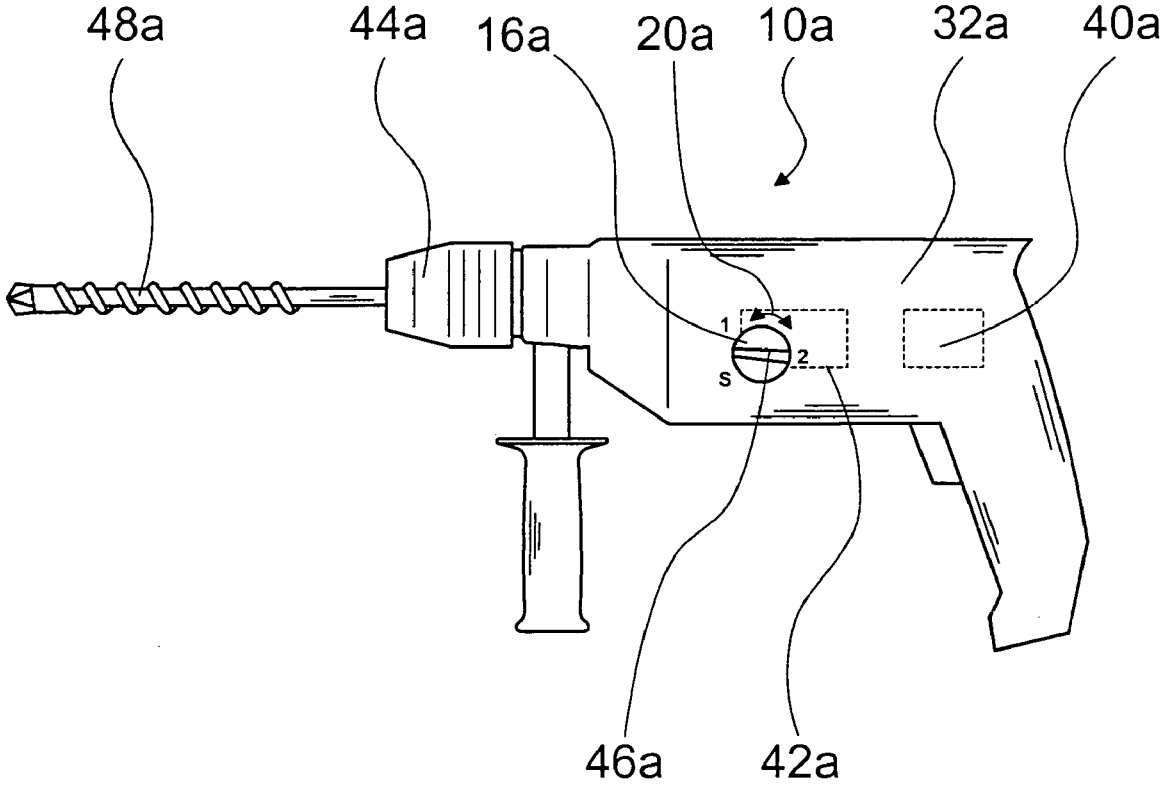
FIG. 1 shows a percussion drill with a user-operation element of a shifting device.
Figure 2:
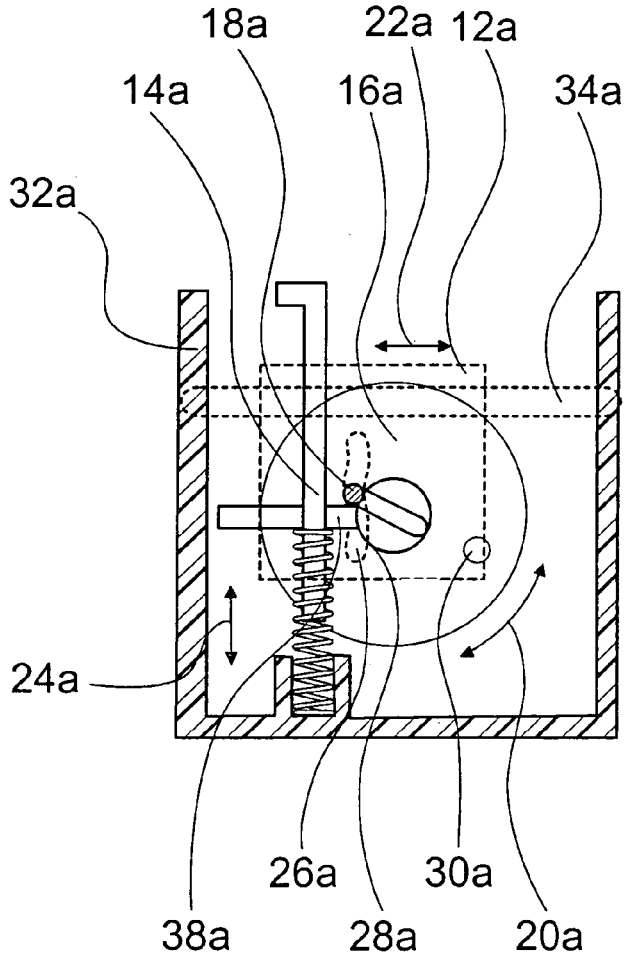
FIG. 2 is an internal view of the shifting device of FIG. 1.

FIG. 1 shows an electric power tool, embodied as a percussion drill 10*a*, with an electric motor 40*a* and with a gear-changing mechanism 42*a* by way of which a torque generated by the electric motor 40*a* can be transmitted in two different gear ratios to a tool bit 48*a* fastened in a drill chuck 44*a*.

Figure 3:
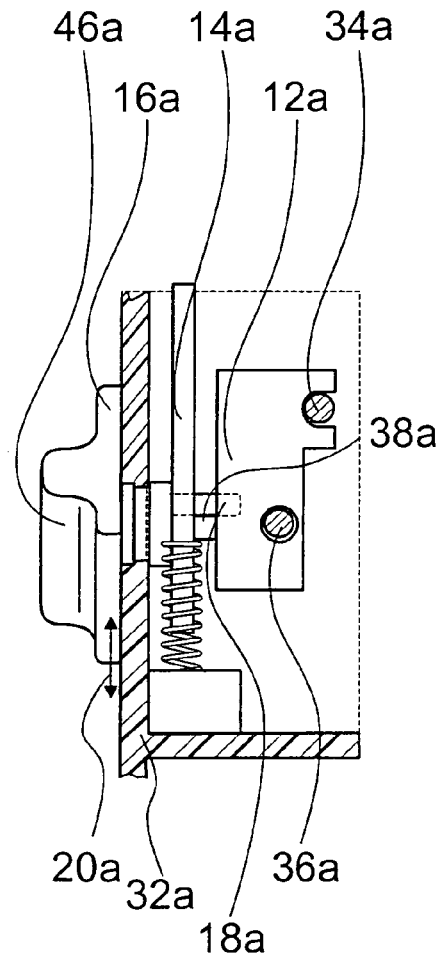
FIG. 3 is a side view of the shifting device of FIGS. 1 and 2.

For changing the gear ratios, the hand power tool embodied as a percussion drill 10*a* includes a shifting device, which has a user-operation element 16*a* that is visible from outside and that is rotatably supported in a housing 32*a* of the percussion drill 10*a*. The user-operation element 16*a* includes a toggle bar 46*a*, which is integrally formed onto a circular outer region of the user-operation element 16*a* that is located on an outside of the housing 32*a* (FIG. 3). On a side facing away from the toggle bar 46*a*, the user-operation element (16*a* has a cylindrical peg, which protrudes through the housing 32*a* of the percussion drill 10*a* into an interior and which has a circumferential bearing groove that is engaged by the housing and that axially fixes the user-operation element 16*a*, embodied as a cast plastic part, in the housing 32*a*.

On one face end of the peg, this peg has a channel-like recess extending along the peg diameter and engaged by a converter element 18*a* of steel wire that has a peglike end which extends axially away from the user-operation element 16*a* and is intended for engaging a first shifting element 12*a* and a second end which axially engages a recess in the user-operation element 16*a* and fixes the converter element 18*a* perpendicular to the channel-like recess.

The first shifting element 12*a* is supported displaceably, in a direction 22*a* extending perpendicular to the axis of rotation of the user-operation element 16*a*, on two rods 34*a*, 36*a* that are structurally connected to the housing, and on its side toward the user-operation element 16*a*, it has a gear shifting gate 26*a*, which is embodied as a snakelike recess and is engaged, in the installed state, by the peg of the converter element 18*a*.

The face end of the peg of the user-operation element 16*a* and the first shifting element 12*a* have a spacing of about 0.5 cm that is engaged by a crosspiece 38*a* of a second shifting element 14*a* which is supported displaceably in the housing 32*a* in a direction 24*a* that extends perpendicular to the axis of rotation of the user-operation element 16*a* and to the direction 22*a*. The crosspiece 38*a* engages a circular path curve of the converter element 18*a*. Because of the contact of the first shifting element 12*a* with the second shifting element 14*a*, both shifting elements 12*a*, 14*a* are guided in a plane defined by the directions 22*a*, 24*a*.

The user-operation element 16*a* furthermore has a detent element 30*a*, embodied as a spring-loaded detent ball, which is intended for snapping into corresponding recesses, not explicitly shown here, in the housing 32*a*. The housing 32*a* has a total of three such recesses, each associated with one shifting position of the shifting device, and they each fix the user-operation element 16*a* in one rotary position. Each of the shifting positions is indicated by a marking on the housing 32*a*.

Figure 4A:
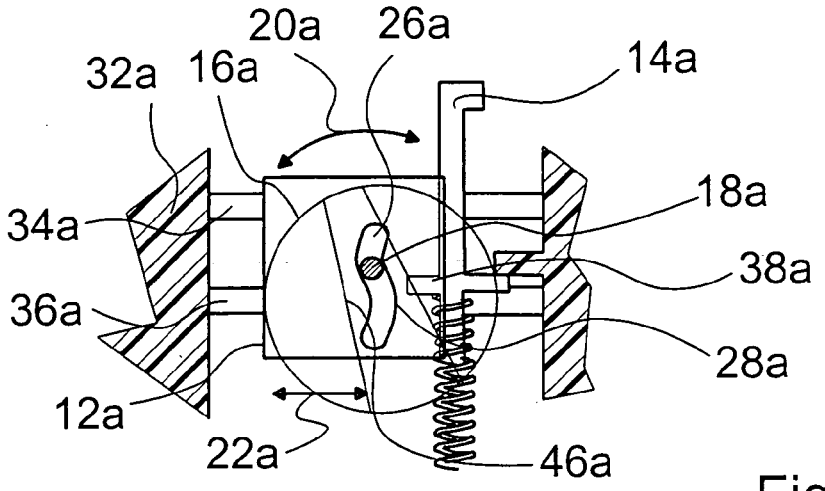
FIGS. 4*a*-4*c* show a sequence of configurations of the shifting device of FIGS. 1-3 during a shifting event.
Figure 4B:
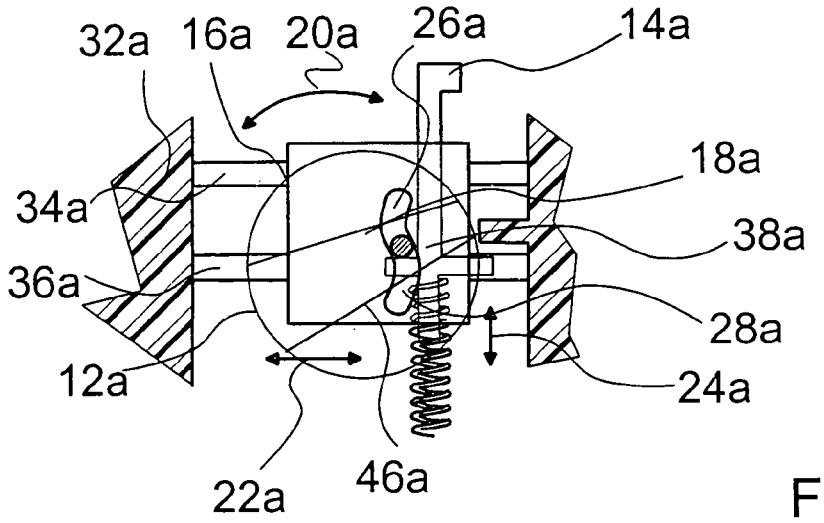
Figure 4C:
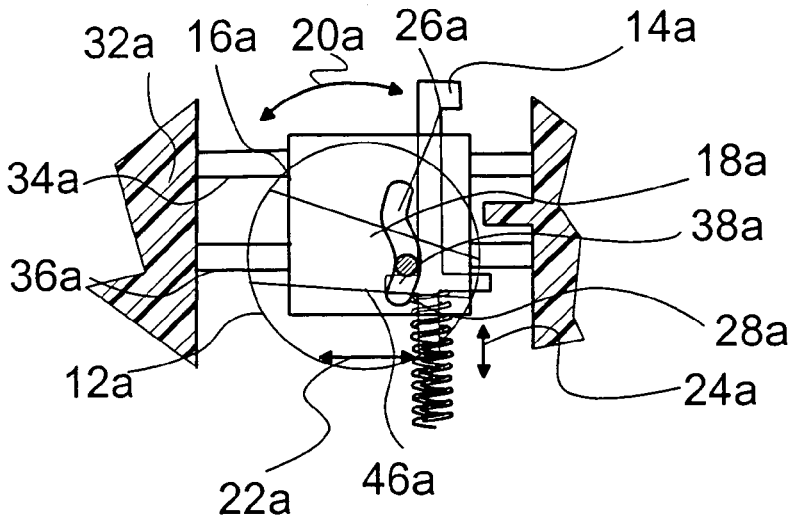

FIGS. 4*a*-4*c* show a sequence of configurations of the shifting device during a shifting event from a first shifting position via a second shifting position to a third shifting position. The user-operation element 16*a*, located above the plane of the drawing, is indicated by fine lines.

In the first shifting position, which is associated with a relatively high gear ratio of the gear-changing mechanism 42*a* and is not explicitly shown here, the toggle bar 46*a* is oriented essentially parallel to the rods 34*a*, 36*a*, or in other words parallel to an axis of rotation of the tool bit 48*a*. If a user twists the user-operation element 16*a* by about 1600, he puts the shifting device into a second shifting position, which is associated with a lower gear ratio of the gear-changing mechanism 42*a* (FIG. 4*b*). The peg of the converter element 18*a* slides back and forth several millimeters in the second direction 24*a* in the gear shifting gate 26*a* and displaces the first shifting element 12*a* and the gear shifting gate 26*a* in the first direction 22*a*. As a result, the converter element 18*a* converts a rotary motion 20*a* into a displacement of the first shifting element 12*a*. The first shifting element 12 is connected via a spring element to a shifting fork, not shown here but known per se, which mediates an engagement of the first shifting element 12*a* with the gear-changing mechanism 42*a* and which upon a rotary motion 20*a* from the first to the second shifting position trips a change of gear ratio of the gear-changing mechanism 42*a*.

If the user twists the user-operation element 16*a* by a further 60° into a third shifting position (FIG. 4*c*), the peg slides into a circular-arc-shaped portion 28*a* of the gear shifting gate 26*a*, in which the gear shifting gate 26*a* at every point extends at a tangent to the circular-arc-shaped path curve of the converter element 18*a*, so that a location of the first shifting element 12*a* in this portion of the rotary motion 20*a* relative to the housing 32*a* of the percussion drill 10*a* remains constant. A radius of the circular-arc-shaped portion 28*a* corresponds to an eccentricity of the converter element 18*a*. During this portion of the rotary motion 20*a*, the converter element 18*a* comes to rest against the crosspiece 38*a* of the second shifting element a41 in the second shifting position, and the converter element 18*a* displaces the second shifting element 14*a*, via the crosspiece 38*a*, in the direction 24*a* without tripping shifting of the gear-changing mechanism 42*a*.

The second shifting element 15*a*, by the motion in the direction 24*a*, by the closing of a current circuit, trips an electronic shifting event in a control unit of the percussion drill 10*a*, which as a result shifts into a different operating mode.

The second shifting element 14*a* is spring-loaded, so that upon a rotary motion 20*a* of the user-operation element 16*a* it returns from the third shifting position to the second shifting position automatically. The first shifting element 12*a* is loaded from both sides by a spiral spring which is slipped onto the rod 36*a* and prevents play of the first shifting element 12*a*. When the user-operation element 16*a* is in a rotary position that is between the first shifting position and the second shifting position, the second shifting element 14*a* is braced on a crosspiece that is integrally formed onto the housing 32*a*.

Figure 5:
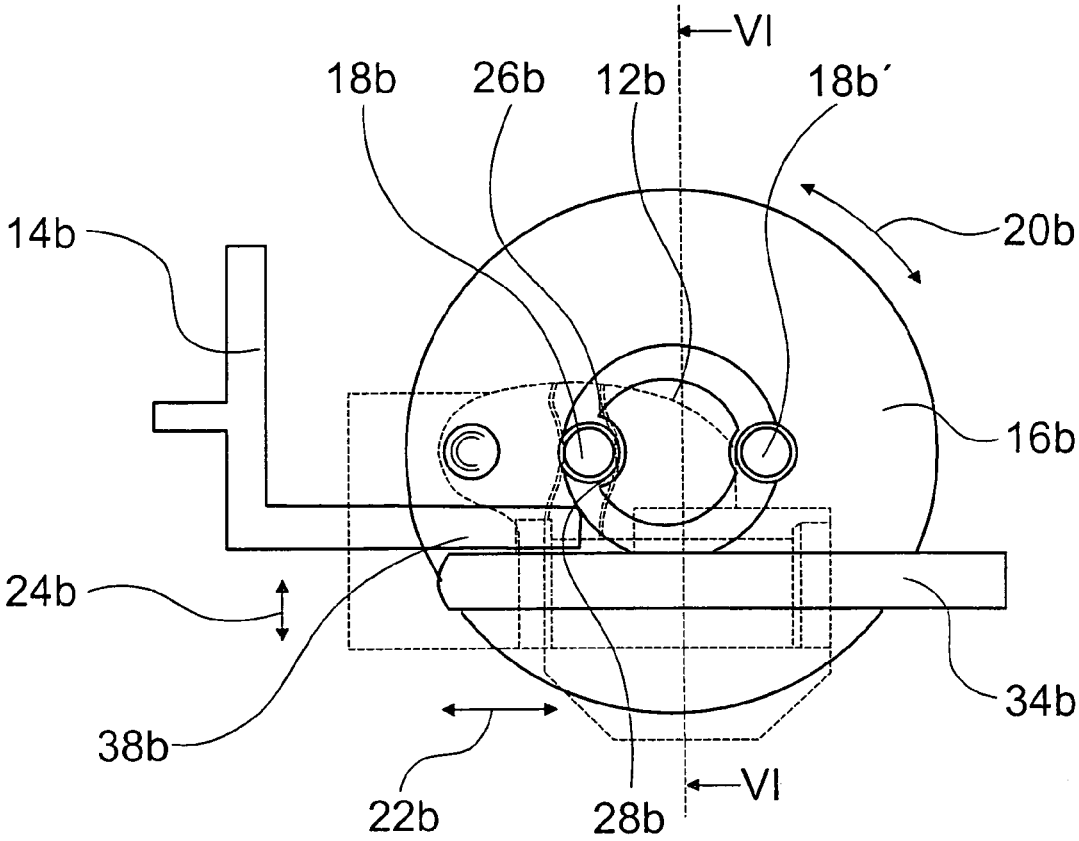
FIG. 5 is an internal view of an alternative shifting device.
Figure 6:
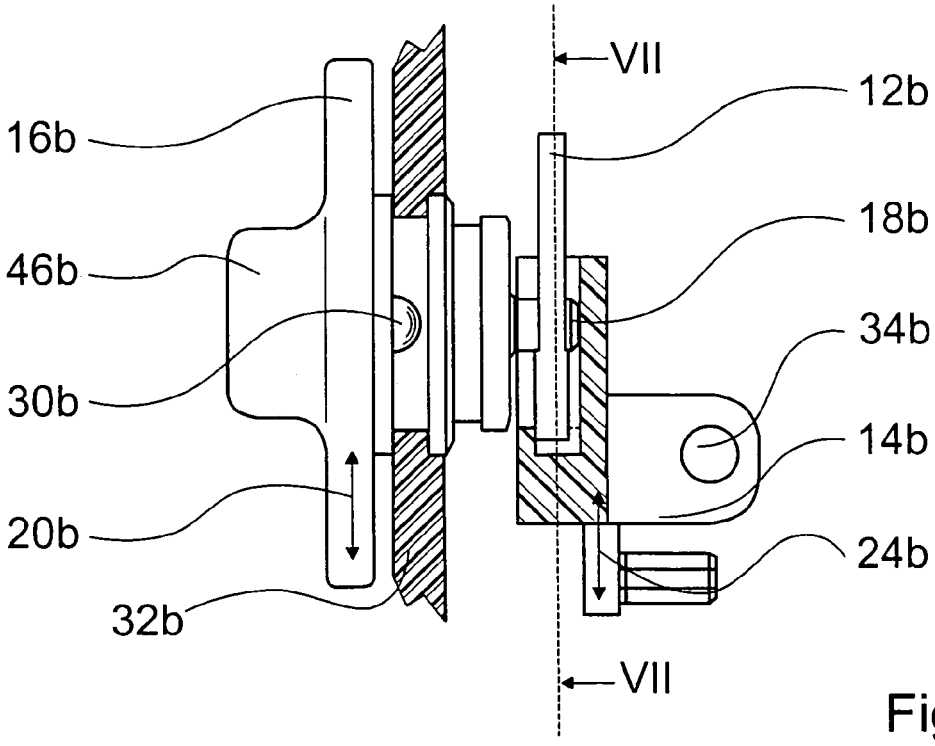
FIG. 6 is a side view of the shifting device of FIG. 5.
Figure 7A:
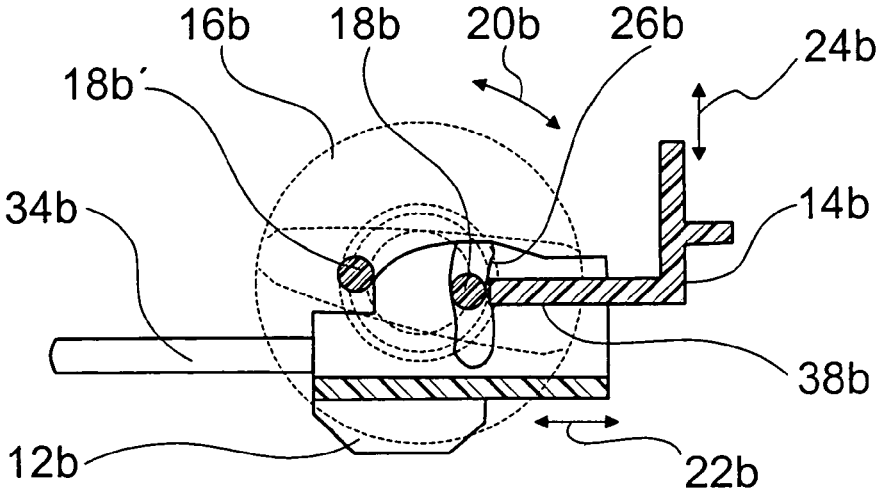
FIGS. 7*a*-7*c* show a sequence of configurations of the shifting device of FIGS. 5 and 6 during a shifting event.
Figure 7B:
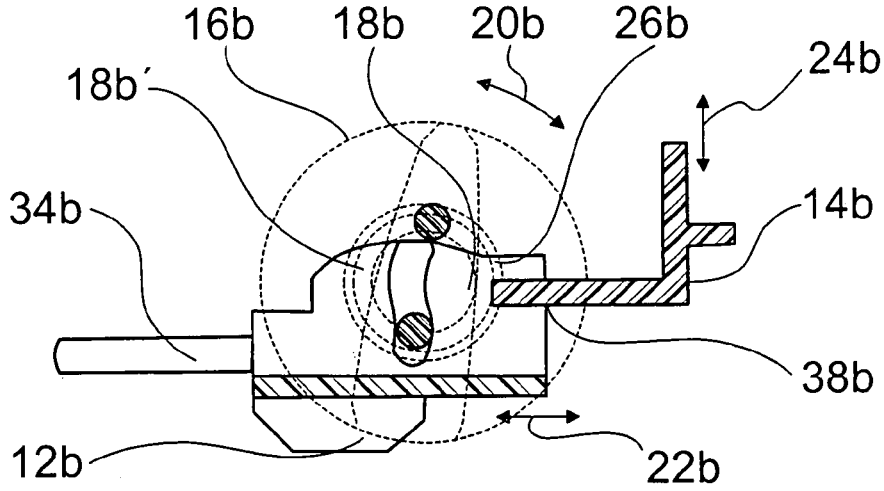
Figure 7C:
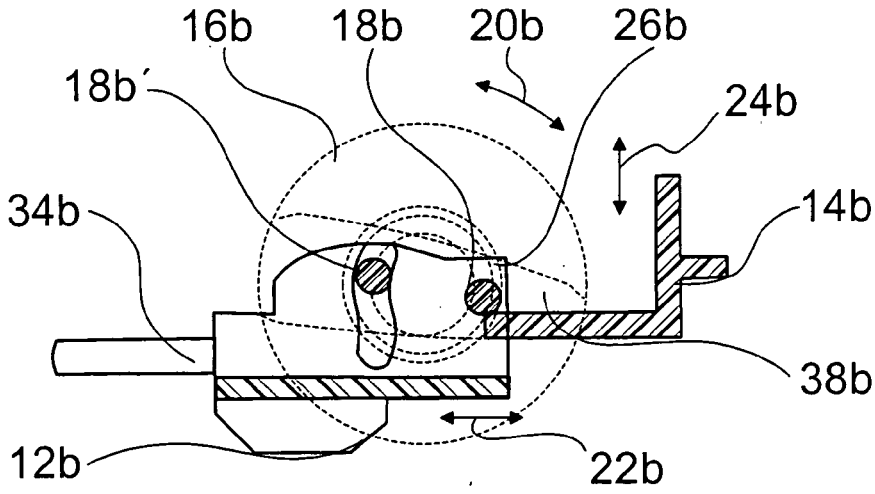

FIGS. 5-7 show a further embodiment of the invention. In the ensuing description, it will essentially be the differences from the exemplary embodiment shown in FIGS. 1-4 that are addressed. Analogous characteristics are identified by the same reference numerals, with the letters a and b added to distinguish between the exemplary embodiments.

The user-operation element 16*b* shown in FIG. 5 has two pinlike converter elements 18*b*, 18*b*', which are integrally formed onto the user-operation element 16*b* in a casting process and which protrude axially into the interior of a housing of a percussion drill. The converter element 18*b* has a lesser eccentricity than the second converter element 18*b*', and so the first converter element 18*b* can be twisted past a crosspiece 38*b* on a second shifting element 15*b*.

The first converter element 18*b* engages a gear shifting gate 26*b*, which is embodied as a channel-like recess in a first shifting element 12*b*. Upon a rotary motion 20*b* between a first shifting position (FIG. 7*a*) and a second shifting position, the first converter element 18*b* converts the rotary motion 20*b* of the first shifting element 12*b* into a displacement of the first shifting element 12*b* in a first direction 22*b* that extends perpendicular to an axis of rotation of the user-operation element 16*b*.

If the user twists the user-operation element 16*b* farther into a third shifting position (FIG. 7*c*), then the second converter element 18*b*', which in the second shifting position comes into contact with the crosspiece 38*b* of the second shifting element 14*b*, displaces the second shifting element 14*b* in a second direction 24*b*, which extends perpendicular both to the axis of rotation of the user-operation element 16*b* and to the first direction 22*b*.

It will be understood that each of the elements described above, or two or more together, may also find a useful application in other types of constructions differing from the types described above.

While the invention has been illustrated and described as embodied in a shifting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention.

The invention claimed is:

1. A shifting device, comprising a first shifting element; a second shifting element; and a rotatably supported user-operation element including a first converter element for converting a rotary motion of said user-operation element into a displacement of said first shifting element in a first direction, said user-operation element also including a second converter element for converting the rotary motion of said user-operation element into a displacement of said second shifting element in a second direction, wherein said converter elements are configured so that said first direction extends at least substantially perpendicular to said second direction, wherein said first shifting element is engageable with a gear-changing mechanism, wherein said second shifting element is configured to trip a shifting event selected from the group consisting of an electronic shifting event and a mechanical shifting event, and wherein said first shifting element is in contact with said second shifting element.

2. A shifting device as defined in claim 1; and further comprising a gear shifting gate for guiding said first converter element.

3. A shifting device as defined in claim 2, wherein said gear shifting gate in at least one rotary position of said user-operation element extends at a tangent to a curved path of said first converter element.

4. A shifting device as defined in claim 2, wherein said gear shifting gate is configured in at least one portion as a circular arc.

5. A shifting device as defined in claim 2, wherein said first shifting element includes said gear shifting gate.

6. A shifting device as defined in claim 1; and further comprising at least one detent element for fixing a rotary position of said user-operation element.

7. A shifting device as defined in claim 1, wherein said first converter element for converting the rotary motion of said user-operation element into the displacement of said first shifting element is embodied separately from said second converter element for converting the rotary motion of said user-operation element into the displacement of said second shifting element.

8. A shifting device as defined in claim 1, wherein said shifting device is configured as a shifting device for an electric power tool.

9. A hand power tool, comprising a shifting device including a first shifting element; a second shifting element, and a rotatably supported user-operation element including a first converter element for converting a rotary motion of said user-operation element into a displacement of said first shifting element in a first direction, said user operation element also including a second converter element for converting the rotary motion of said user-operation element into a displacement of said second shifting element in a second direction, wherein said converter elements are configured so that said first direction extends at least substantially perpendicular to said second direction, wherein said first shifting element is engageable with a gear-changing mechanism, wherein said second shifting element is configured to trip a shifting event selected from the group consisting of an electronic shifting event and a mechanical shifting event, and wherein said first shifting element is in contact with said second shifting element.

10. A hand power tool as defined in claim 9, wherein the hand power tool is configured as a percussion drill.

* * * * *